United States Patent [19]

Gregoire et al.

[11] 4,383,561

[45] May 17, 1983

[54] INFEED TABLE FOR LUMBER EDGER

[75] Inventors: James L. Gregoire, Decatur; Robert D. Wismer, Roswell; Robert L. Brouer, Conyers, all of Ga.

[73] Assignee: Forest Industries Machine Corp., Conyers, Ga.

[21] Appl. No.: 251,131

[22] Filed: Apr. 6, 1981

[51] Int. Cl.[3] ..... B27B 1/00; B27B 31/06

[52] U.S. Cl. ..... 144/245 A; 83/367; 144/357; 198/456

[58] Field of Search ..... 198/434, 456, 457; 83/367, 370, 364, 368, 376, 365, 425.1; 144/245 R, 245 A, 118, 220, 356, 357

[56] References Cited

U.S. PATENT DOCUMENTS

| | | | |
|---|---|---|---|
| 3,970,128 | 7/1976 | Kohlberg | 144/357 |
| 4,239,072 | 12/1980 | Merilainen | 144/357 |
| 4,240,477 | 12/1980 | Horn et al. | 144/357 |
| 4,269,245 | 5/1981 | Fornell et al. | 144/356 |

*Primary Examiner*—W. D. Bray
*Attorney, Agent, or Firm*—B. J. Powell

[57] ABSTRACT

An infeed table for an edging device adapted to trim the longitudinal wane edges of a sawn cant to produce dimensioned lumber as the cant is moved therethrough along a prescribed edging path including an infeed conveyor for moving the sawn cant into the edging device along the edging path; and a pair of positioning assemblies are positioned along the infeed conveyor means at spaced apart positions to selectively clamp the cant therein and shift the cant transversely of the edging path to orient the cant with respect to the edging path. A manual control is provided for the positioning assemblies to selectively shift the cant and an automatic control is also provided for shifting the positioning assemblies to a position centered on the edging path when the manual control is not activated. A set control is provided for causing the positioning assemblies to shift one edge of the cant to fixed distance from the edging path.

10 Claims, 14 Drawing Figures

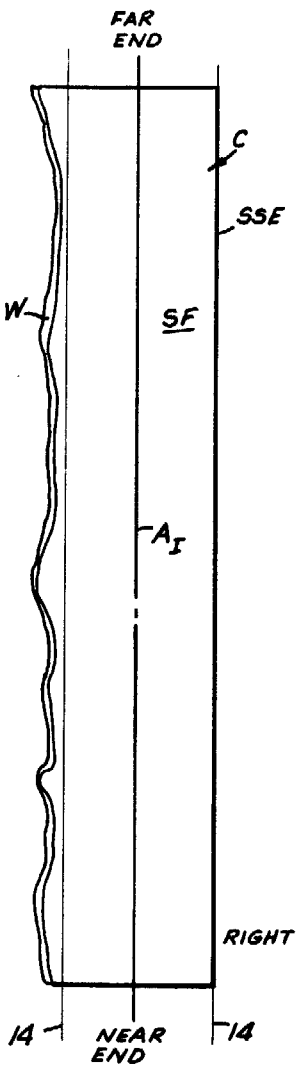
FIG 12
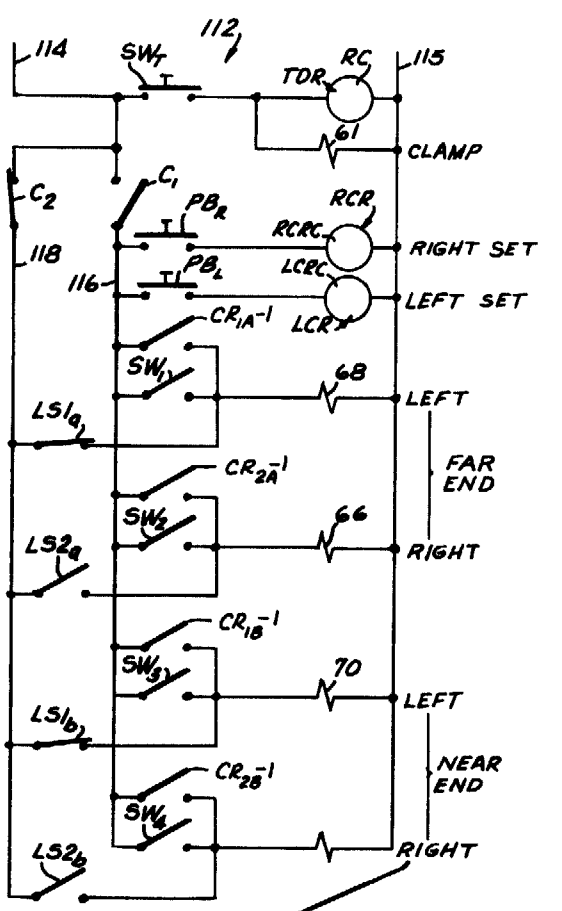
FIG 13
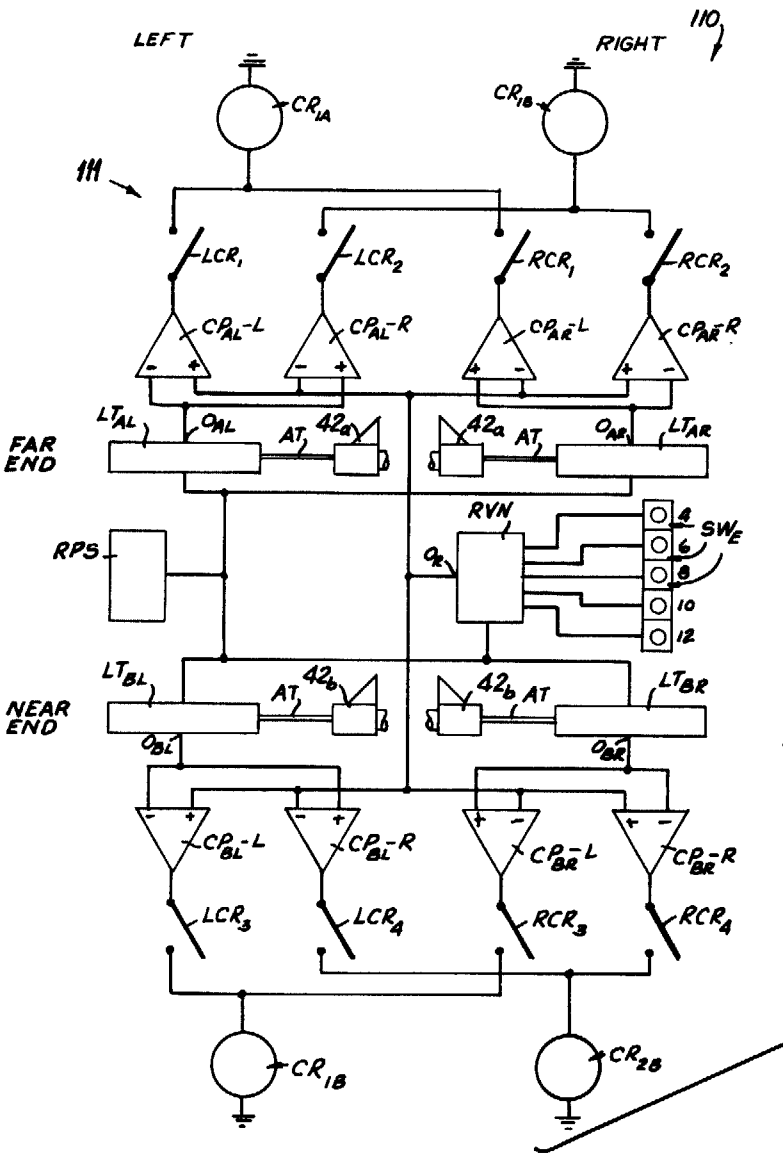

INFEED TABLE FOR LUMBER EDGER

BACKGROUND OF THE INVENTION

This invention relates generally to the edging of sawn cants to form dimensioned lumber and more particularly to infeed tables for orienting sawn cants for edging.

In the manufacture of dimensioned lumber from trees, the tree is initially sawn with a series of parallel cuts to form cants. The resulting cants have opposed sawn faces which are parallel to each other and irregularly shaped wanes along opposite side edges of the cant. The wanes are subsequently removed with edgers to form the cant into dimensioned lumber.

In the edging operation, the cant is moved through the edger along a straight edging path with spaced apart cuts taken along opposite side edges of the cant parallel to the edging path. The spacing between the parallel cuts is such that all of the wane is removed and the resulting lumber has a standard width. Because the wanes along opposite side edges of the cant are irregular, however, the orientation of the cant with respect to the edging path affects the lumber yield from the cant after edging. Thus, there is a need to orient the cant with respect to the edging path prior to entry into the edger to insure that the wane will be removed and the lumber yield will be increased.

One of the most common prior art techniques used to orient cants for edgers is the use of a straight edge against which the side of the cant is abutted for orientation. Typically, the straight edge is oriented parallel to the straight edging path through the edger and can be shifted laterally of the edging path under manual control until the cuts to be made by the edger will remove the wanes. This technique does not permit the cant axis to be selectively skewed with respect to the edging path after it abuts the straight edge. As a result, the maximum lumber yield from the cant is typically not maximized.

More recently, techniques of optically scanning the cant have been introduced. As the cant is moved to its feed position for the edger, the cant is optically scanned as to size and shape and this information supplied to a computer. The computer then determines the desired orientation of the cant with respect to the edging path to maximize the lumber yield from the cant and orients the cant on the infeed table to the edger for this yield. While this technique does have the capability to orient the cant for maximum lumber yield, the initial cost of these systems in high, thereby making such systems economically unfeasible except very high speed edging operations. Further, because the systems typically cannot handle all cant configurations, an operator is still required.

SUMMARY OF THE INVENTION

These and other problems and disadvantages associated with the prior art are overcome by the invention disclosed herein by providing a manual controlled orienting mechanism which permits sufficient orientation of a cant with respect to the edging path to maximize the lumber yield from the cant while at the same time being economically feasible for use in a wide range of edging operations. The invention automatically preorients the cant at a centered position with respect to the edger path so that the time required to further orient the cant under manual control until the desired orientation with respect to the edger path is reached for maximum lumber yield is minimized. Further, the invention provides the automatic orientation of the edge of the cant to preprogrammed positions to minimize the time required to orient the cant when one of the side edges of the cant has been performed.

The apparatus of the invention includes an infeed table with a support frame mounting an infeed conveyor therein for feeding a sawn cant longitudinally of itself into an edging device along a prescribed edging path so that the edger will remove opposite side edges of the cant to form dimensioned lumber. A pair of positioning assemblies are mounted on the support frame at spaced apart positions along the infeed conveyor with each of the positioning assemblies capable of clamping the cant therein and shifting opposite ends of the cant transversely of the edging path to orient the cant with respect to the edging path. After the cant has been oriented with respect to the edging path, the positioning assemblies release the cant onto the infeed conveyor so that the cant is fed into the edger along the edging path. The positioning assemblies are constructed and arranged so that the portion of the cant clamped in each positioning assembly is initially located centered on the edging path and manual control means is provided for selectively causing each of the positioning assemblies to further shift the cant transversely of the edging path as desired to orient the cant with respect to the edging path. To assist the operator in orienting the cant with respect to the edging path, a guide light assembly is provided which projects a pair of spaced apart guide light beams onto the cant while it is being positioned with the location of the guide light beams corresponding to the position at which the edger will cut the cant so that the operator can visually predetermine where the cant will be cut for orientation by the positioning assemblies. When the cant has a preformed side edge thereon with the wane on that side removed, the operator can further orient the positioning assemblies so that the straight side edge on the cant is located in alignment with one of the guide light beams without having to orient the cant by visually matching the guide light beams with the cant.

These and other features and advantages of the invention disclosed herein will become more clearly understood upon consideration of the following description and accompanying drawings wherein like characters of reference designate corresponding parts throughout the several views and in which:

BRIEF DESCRIPTION OF THE DRAWINGS

FIG. 12 is a view illustrating another cant with which the invention is used; and FIG. 13 is an electrical schematic illustrating a second embodiment of the control circuit of the invention.

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Figure 1A:
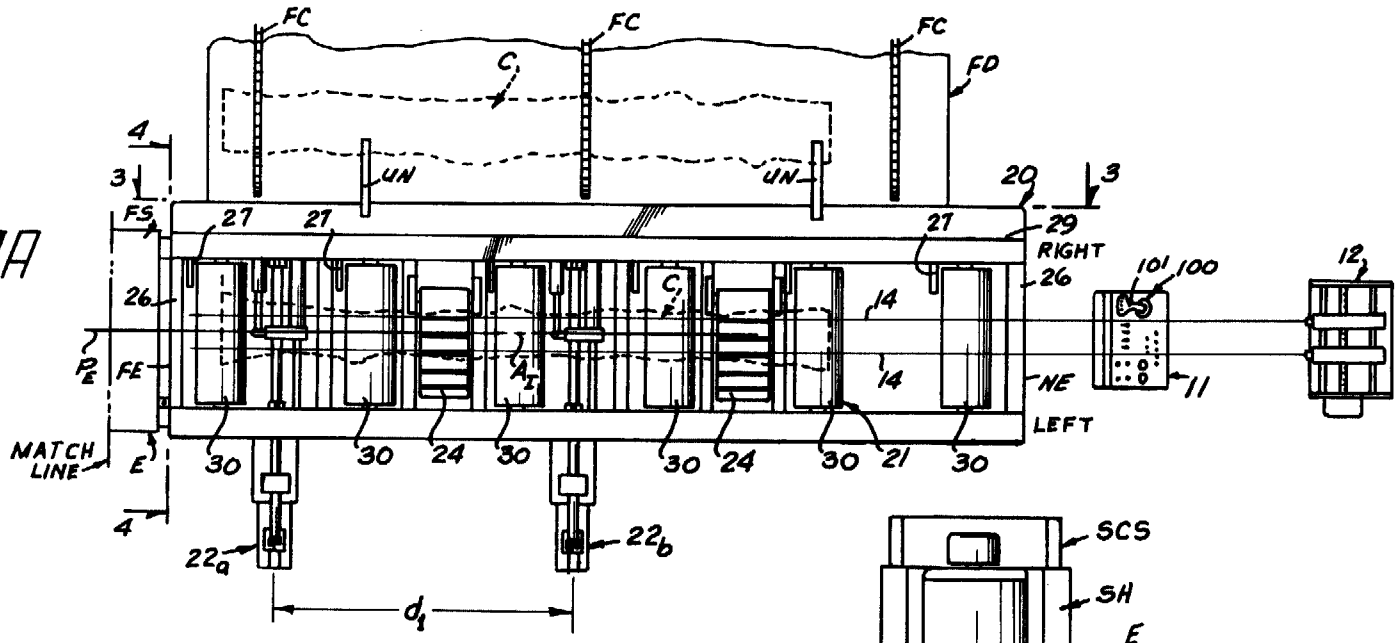
FIGS. 1A and 1B together form a top plan view of an edging system incorporating the invention.
Figure 1B:
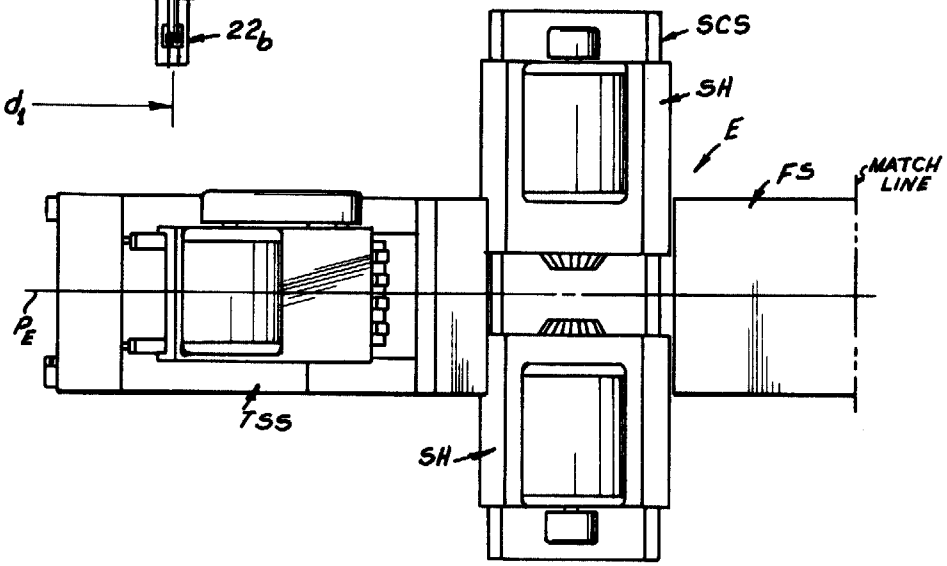

The invention of this application is incorporated in an edging system which is used to form dimensioned lumber from cants sawn from a tree trunk. FIGS. 1*a* and 1*b* show the overall system incorporating the invention. The edging system includes a conventional edger E through which the cant is passed along a straight edging path $P_E$ so that opposite side edges of the cant are trimmed. The edger E illustrated also has the capability of adjusting the thickness of the cant. An infeed table assembly 10 is provided at the infeed end of the edger E for supplying the cant to the edger E and for orienting the cant with respect to the edging path. The infeed table assembly 10 has a straight infeed axis $A_I$ which is oriented coaxially with the edging path $P_E$ and the infeed table assembly 10 is used to orient the cant with respect to the infeed axis $A_I$ so that, when the infeed table assembly 10 supplies the cant to the edger E, the cant will be properly oriented with respect to the edging path $P_E$ for the cant to be edged into dimensioned lumber. A conventional feeding device FD is provided for supplying the cants to the infeed table assembly 10. A control console 11 is provided at that end of the infeed table assembly 10 opposite the edger E and is operatively connected to the infeed table assembly 10 to allow an operator to position the cant on the infeed table assembly 10. For sake of convenience, that end of the infeed table assembly 10 at the console 11 will be referred to as the near end NE and that end at the edger E will be referred to as the far end FE.

To assist the operator in orienting the cant with respect to the infeed axis $A_I$ and thus the edging path $P_E$, a conventional guide light assembly 12 is provided which projects a pair of spaced apart coherent light beams indicated at 14 onto the cant in the infeed table assembly 10 to permit the operator to visually determine where the edger E will make the edging cuts on the cant while it is located on the infeed table assembly 10. Thus, it will be seen that the operator, using the control console 11, orients the cant with respect to guide light beams 14 on the infeed table assembly 10 and then activates the infeed table assembly 10 to supply the cant to the edger E for edging while the desired orientation is maintained on the cant.

The edger E includes feeding section FS to which the cant is supplied by infeed table assembly 10. The feeding section FS grips the cant to maintain its orientation and supplies the cant to a side cutting section SCS which makes a pair of side cuts along opposite sides of the cant. The cant is then supplied to the top slabbing section TSS which reduces the cant to the desired thickness. The dimensioned lumber formed from the cant then passes out of the top slabbing section TSS. The side cutting section SCS includes a pair of side heads SH which can be incrementally adjusted equidistant from opposite sides of the edging path $P_E$ in known manner so that different standard widths of dimensioned lumber can be made from the cants passing therebetween. The guide light assembly 12 is conventionally interconnected to the control of the side heads SH so that the guide light beams 14 are spaced apart the same distance as the spacing of the side heads SH. Typically, the incremental spacing can be changed from four inches to twelve inches in two inch increments. This spacing is under the control of the operator at the control console 11 as will become more apparent.

Figure 2:
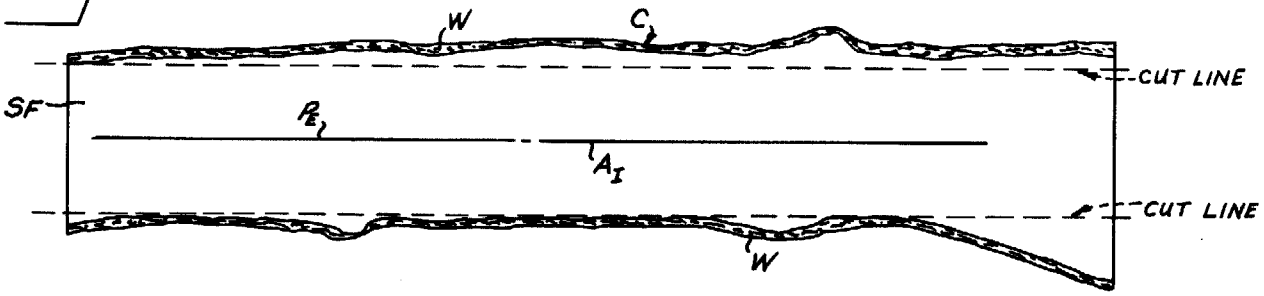
FIG. 2 is a view showing a typical cant with which the invention is used.

FIG. 2 illustrates a typical cant C which has been sawn from a tree trunk. The cant C has a pair of parallel spaced apart sawn faces SF forming the thickness of the cant and wanes W formed along opposite longitudinally extending side edges of the cant C. Typically, one of the sawn faces SF is narrower than the other because of the generally circular configuration of the tree trunk and this narrower sawn face SF is normally turned upwardly during the orientation of the cant for edging. FIG. 2 shows the narrower face SF turned up. To maximize the lumber yield from the sawn cant C, it will be seen that the cuts made along opposite side edges of the cant C need to remove the wanes W, but the cuts need to be spaced apart a maximum distance to maximize the lumber yield. This requires orienting the cant C so that the parallel side cuts pass just inside the wanes W as illustrated by dashed lines superimposed on the cant C seen in FIG. 2. Because of the irregularity of the wanes W, the center line of the cant C does not necessarily coincide with the edging path $P_E$ as the cant C is moved through the edger. The infeed table assembly 10 is designed so that the cant C can be oriented with respect to the guide light beams 14 until the guide light beams pass just inside the wanes W, yet are maximally spaced apart to maximize the lumber yield from the cant C.

For sake for convenience, the direction in which the operator moves the cant transversely of the infeed axis $A_I$ will be taken as the operator views the cant from the control console 11. These directions are labelled on the drawings as "right" and "left" when one views the infeed table assembly 10 while standing at the operator position at the console 11 facing the infeed table assembly 10.

The infeed table assembly 10 as seen in FIG. 1 includes a support frame 20 which mounts therein an infeed conveyor 21 adapted to move a cant thereon longitudinally of the infeed table assembly 10 along an infeed path parallel to the infeed axis $A_I$. A pair of positioning assemblies 22 are also mounted on the support frame 20 for orienting the cant C on the infeed conveyor 21 as will become more apparent. A pair of cant turning assemblies 24 are also mounted on the support frame 20 and adapted to selectively turn the cant over on the infeed conveyor 21, if required, to expose the narrower of the sawn faces SF on the cant C as will become more apparent.

The support frame 20 as best seen in FIGS. 1 and 3–5 includes a pair of spaced apart side rails 25 joined at their opposed ends by end rails 26 so that the infeed axis $A_I$ is centrally located between side rails 25 and parallel thereto. A pair of upstanding side members 28 are mounted on each of the side rails 25 and extend along the length thereof to define a cant receiving space therebetween. One of the side members 28 is provided with angled deflection plates 29 on the upper edge thereof extending along the length thereof to direct the cants from the feeding device FD into the cant receiving space between the side channels 28. A plurality of deflecting projections 27 are also mounted on the side member 28 mounting deflection plates 29 to deflect the cant in the cant receiving space so that it lies flat on the infeed conveyor 21.

Figure 4:
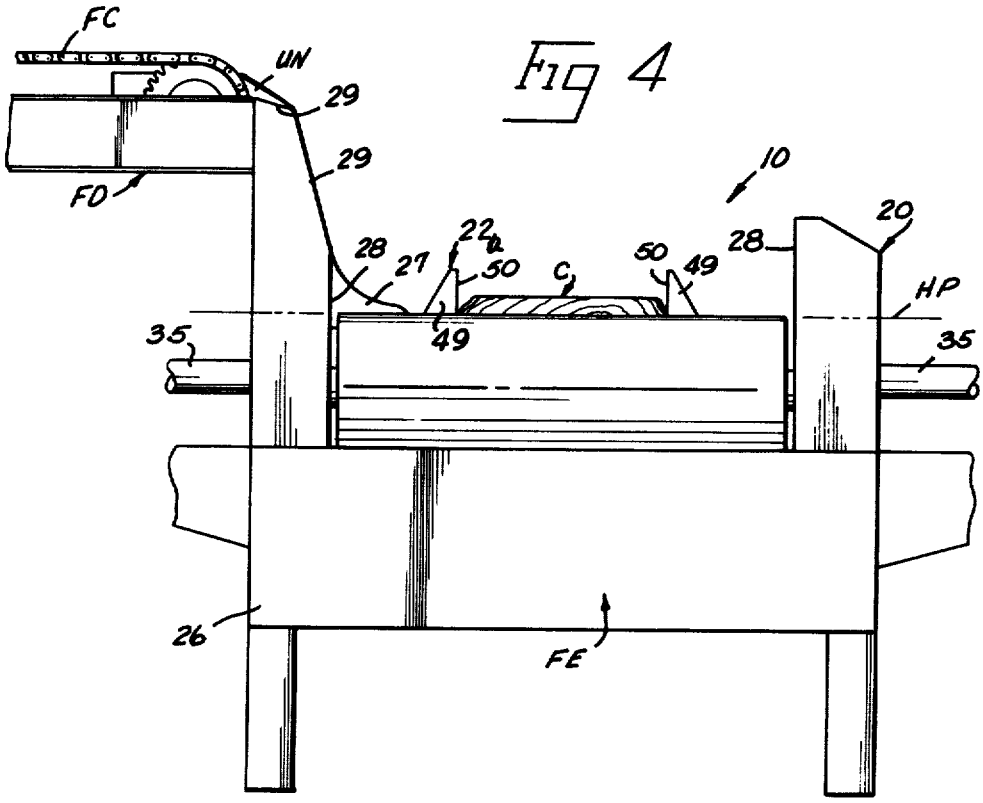
FIG. 4 is an end view of the infeed table assembly taken generally along line 4—4 in FIG. 1A.

As seen in FIGS. 1 and 4, the feeding device FD is adapted to feed the cant C to the infeed table assembly 10 sidewise so that the longitudinal axis of the cant C is oriented generally in the same direction as the infeed axis $A_I$ of the infeed table assembly 10. While different types of feeding devices FD may be used, the feeding device FD illustrated uses feed chains FC which move the cants toward the infeed table assembly 10 and is equipped with appropriate unloaders UN which unload the cants from the feed chains and direct the cants over the deflection plates 29 into the cant receiving space between the side members 28.

Figure 3:
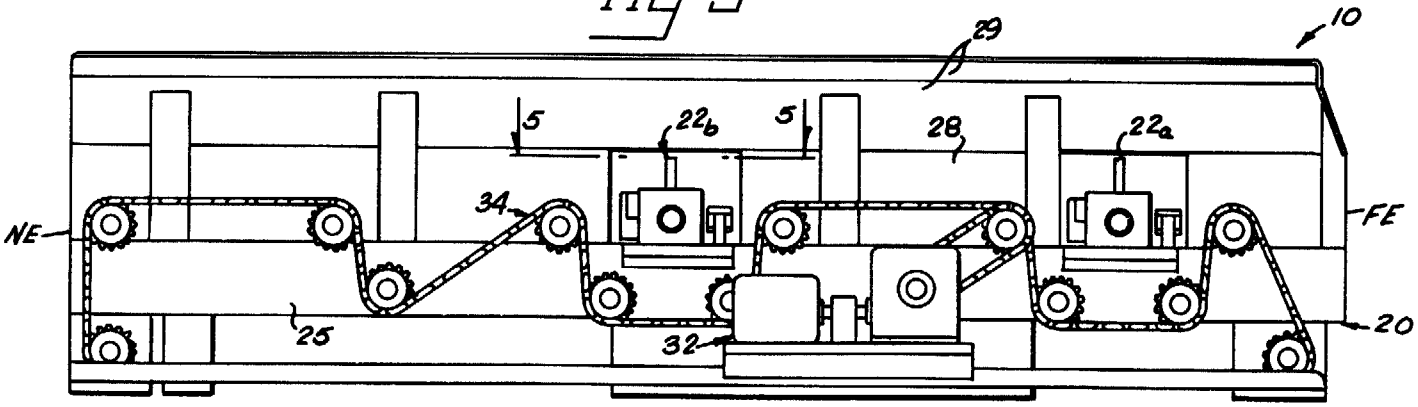
FIG. 3 is an enlarged side elevational view of the infeed table assembly of the invention taken generally along line 3—3 in FIG. 1A.
Figure 5:
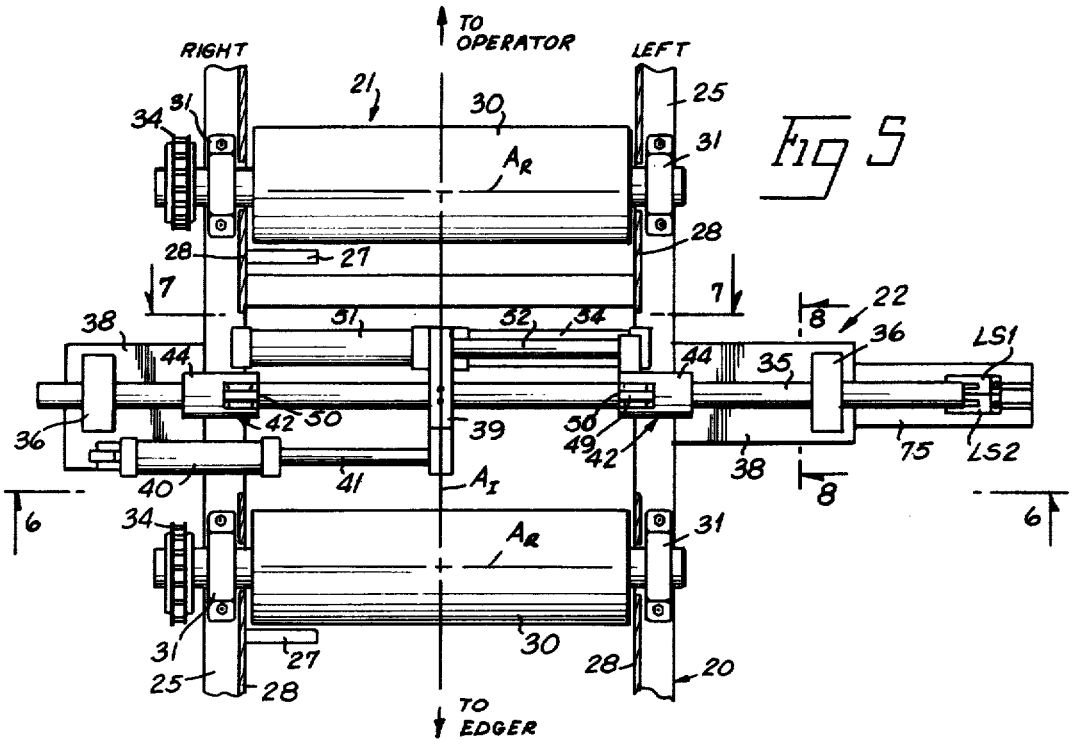
FIG. 5 is an enlarged cross-sectional view taken generally along line 5—5 in FIG. 3.

The infeed conveyor 21 best seen in FIGS. 1, 4 and 5 includes a plurality of infeed rolls 30 rotatably journalled in bearings 31 mounted on the side rails 25 so that the roll axes $A_R$ are horizontal and oriented perpendicular to the infeed axis $A_I$. It will also be noted that the roll axes $A_R$ lie in a common horizontal plane with the rolls 30 extending across the cant receiving space between the side members 28 so that a cant deposited in the cant receiving space between the side members 28 will be supported on top of the infeed rolls 30. Effectively, this supports the cant on a horizontal plane HP extending across the tops of infeed rolls 30. The infeed rolls 30 are located at longitudinally spaced apart positions along the length of the support frame 20 as seen in FIG. 1 so that the cant will be supported along its length on the rolls 30. A drive unit 32 is drivingly connected to one end of each of the infeed rolls 30 outboard of the bearings 31 on one side of the support frame 20 through a chain and sprocket drive 34 as best seen in FIG. 3. The driving unit 32 thus rotates all of the infeed rolls 30 in the same direction to move the cant resting on the top of the rolls 30 toward the edger E. Because of axes $A_R$ of the rolls 30 are all oriented normal to the infeed axis $A_I$ of the infeed table assembly 10, it will be seen that the cant resting on top of the rolls 30 will be moved along a rectilinear path parallel to the infeed axis $A_I$.

The positioning assemblies 22 as best seen in FIG. 1 are located at spaced apart positions within the cant receiving space between the side 28 with each of the positioning assemblies 22 being located in the space between a pair of the infeed rolls 30. One of the positioning assemblies 22 is located adjacent the far end FE of the support table assembly 10 and the other positioning assembly 22 is spaced from this positioning assembly toward the near end NE of the infeed table assembly the distance $d_1$ which is less than the length of the shortest cant likely to be received by the infeed table assembly 10 from the feeding device FD. In order to individually identify the positioning assemblies 22, the positioning assembly adjacent the far end FE of the infeed table assembly 10 will be designated $22_a$ and the other positioning assembly will be designated $22_b$. Both of the positioning assemblies 22 have the same construction. Therefore, only one will be described in detail and the reference numbers applied thereto without subscripts. When the components are referred to for the individual positioning assembly, the subscripts will be used to distinguish therebetween.

Positioning assembly 22 is best seen in FIGS. 5–8 and includes a support rod 35 having a length greater than the distance between the side members 28. The support rod 35 is slidably mounted in bearing blocks 36 mounted on supports 38 projecting outwardly in opposite directions from the side rails 25 on opposite sides of the support frame 20. The support rod 35 is located so that it is horizontal and oriented normal to the infeed axis $A_I$ of the support table assembly 10. The support rod 35 is also located below the support plane HP defined by the tops of the infeed rolls 30 so that the support tube 35 can be axially moved perpendicular to the infeed axis $A_I$ without interfering with the cant supported along plane HP. A central drive block 39 is fixedly attached to the support rod 35 at approximately its mid-point so that support rod 35 can be moved by moving the drive block 39.

A positioning cylinder 40 is pinned to one of the supports 38 projecting outwardly from the side rails 25 and has its piston rod 41 connected to the drive block 29. Normally, the positioning cylinder 40 centers the drive block 39 under the infeed axis $A_I$ as seen in FIG. 5. Thus, it will be seen that extension of piston rod 41 from this position moves the drive block 39 to the left of axis $A_I$ while retraction of the piston rod 41 moves the drive block 39 to the right of axis $A_I$. This action will be further explained.

Figure 6:
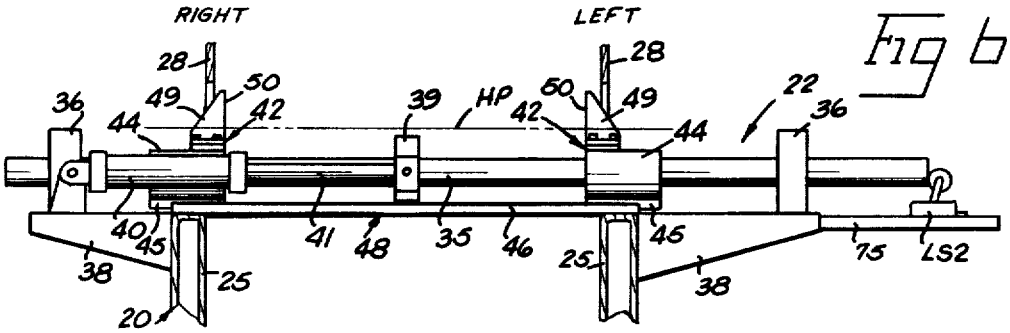
FIG. 6 is a cross-sectional view taken generally along line 6—6 in FIG. 5.
Figure 7:
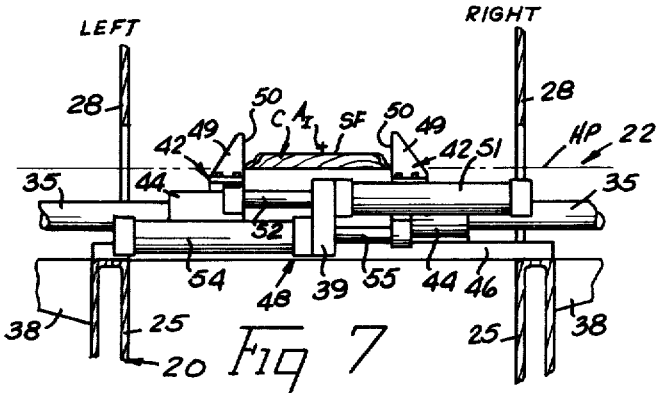
FIG. 7 is a cross-sectional view taken generally along line 7—7 in FIG. 5 showing the positioning assembly with a cant clamped therein.

A pair of clamp assemblies 42 are slidably mounted on the support rod 35 on opposite sides of the drive block 39 so that they can be moved toward each other to clamp a cant resting on the tops of the infeed rolls 30 therebetween as seen in FIG. 7. Each of the clamp assemblies 42 includes a slide collar 44 slidably mounted around the support rod 35 so that the slide collar 44 can be axially moved along the support rod 35 with respect to the drive block 39. The bottom of the slide collar 44 is provided with a guide plate 45 which slidably extends between the upstanding legs 46 on a locating channel 48 seen in FIGS. 6–8 mounted under the support rod 35 between the side rails 25 so that the slide collar 44 is prevented from rotating about the support tube 35 as the slide collar 44 slides along the support rod 35. Mounted on top of the slide collar 44 is a clamping jaw 49 which defines a clamping face 50 thereon facing the infeed axis $A_I$ with the clamping face 50 being vertically oriented. The clamping jaw 49 projects above the support plane HP defined across the tops of the infeed rolls 30 so that, as the clamping assembly 42 is moved toward the drive block 39, the clamping face 50 will engage one of the side edges of the cant supported on top of the infeed rolls 30 while the clamping face 50 on the opposite clamping jaw 49 will engage the opposite side edge of the cant to clamp the cant between the clamping jaws 49 as seen in FIG. 7.

Figure 8:
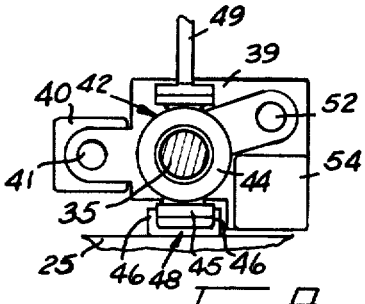
FIG. 8 is an enlarged cross-sectional view taken generally along lines 8—8 in FIG. 5.

A first clamping fluid cylinder 51 is mounted on the drive block 39 and its piston rod 52 projects therefrom in a first direction toward one of the clamp assemblies 42. The piston rod 52 is connected to the slide collar 44 of that clamp assembly 42 toward which it projects. A second clamping fluid cylinder 54 is also mounted on the drive block 39 so that its piston rod 55 projects in the opposite direction from the drive block 39 toward the other clamp assembly 42. The piston rod 55 is connected to the slide collar 44 of that clamp assembly 42. Thus, it will be seen that, as the piston rods 52 and 55 are extended, the clamp assemblies 42 will be moved away from each other and drive block 39; and, as the piston rods 52 and 55 are retracted, the clamp assemblies 42 will be moved toward each other and the drive block 39. Thus, fluid cylinders 51 and 54 serve to open and close the clamp assemblies 42 to selectively engage and release opposite sides of the cant C carried on the top of the infeed rolls 30. The cylinders 51 and 54 have the same stroke so that, when the piston rods thereof are fully extended as seen in FIG. 5, the clamping faces 50 on the clamping jaws 49 of clamp assemblies 42 will be spaced equal distances from and on opposite sides of the drive block 39. When the drive block 39 is centered on the infeed axis $A_I$ as seen in FIG. 5, the faces 50 will also be spaced equal distances from and on opposite sides of the axis $A_I$. As will become more apparent, the cylinders 51 and 54 retract their piston rods at the same speed. Because of this, the clamping faces 50 on clamping jaws 49 remain equidistantly spaced from the drive block 39 as they move toward each other. Thus, when the cant is clamped between the clamping jaws 49 as seen in FIG. 7, the clamping faces 50 will be spaced equidistant from and on opposite sides of the drive block 39. With the drive block 39 centered under the infeed axis $A_I$ as seen in FIG. 8, this serves to center that portion of the cant clamped between jaws 49 on the infeed axis $A_I$.

After the cant has been clamped between the clamping jaws 49, the piston rod 41 of positioning cylinder 40 can be moved to shift the drive block 39 and support rod 35 transversely of the infeed axis $A_I$. Because the clamping cylinders 51 and 54 and clamp assemblies 42 are mounted on the drive block 39 and support rod 35, they are likewise moved as a unit along with the cant clamped thereby. This effectively serves to shift the cant laterally of the infeed axis $A_I$ as will become more apparent.

As best seen in FIG. 1, the far end positioning assembly $22_a$ clamps the cant at a position adjacent the far end of the cant while the near end positioning assembly $22_b$ clamps the cant at a position toward the near end of the cant. As will be explained, the operator can control the positioning cylinder $40_a$ of the far end positioning assembly $22_a$ independently of the positioning cylinder $40_b$ of the near end positioning assembly $22_b$. This allows the operator to shift each end of the cant until it is appropriately aligned with the guide light beams 14 for edging.

Figure 9:
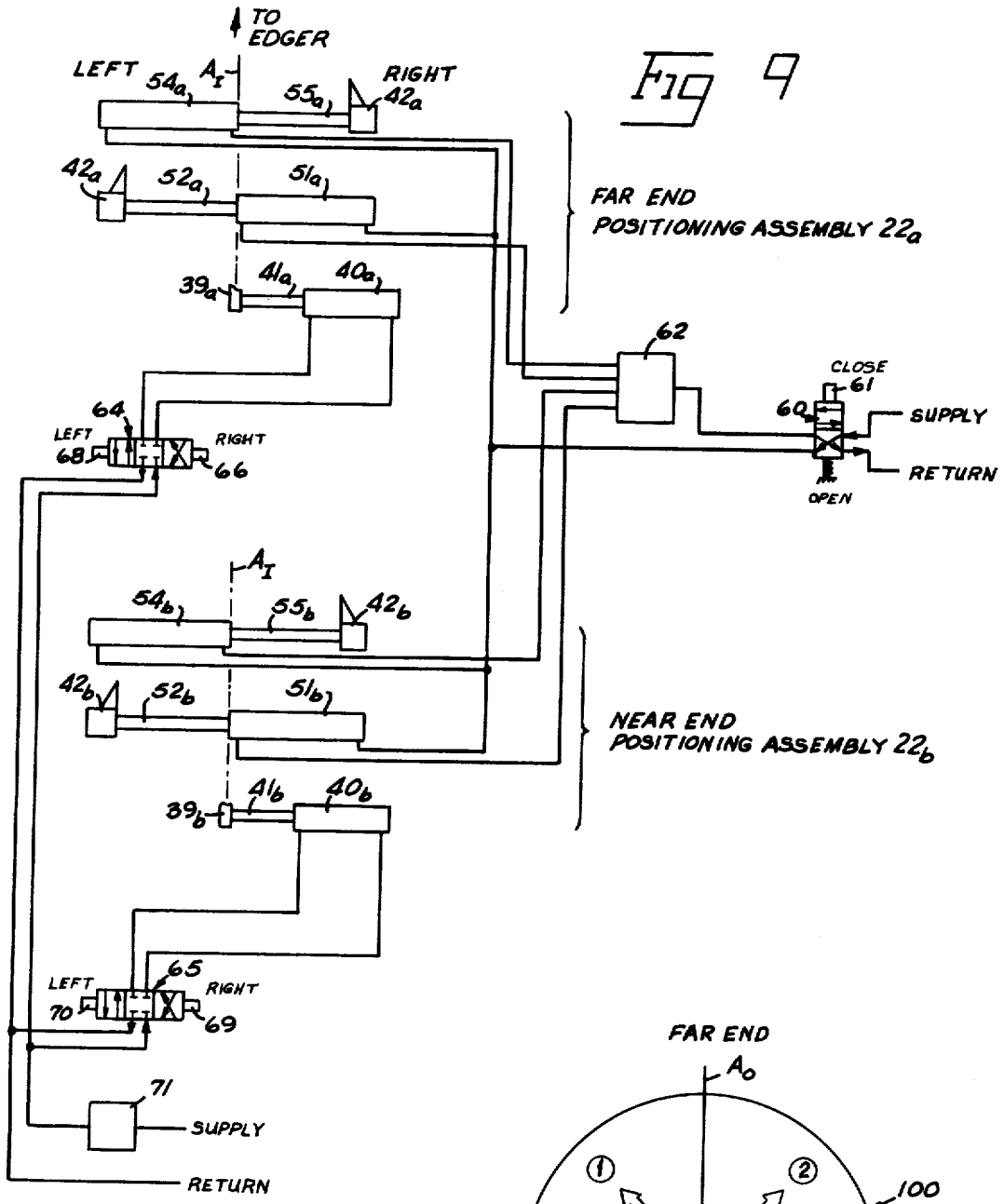
FIG. 9 is a fluid schematic illustrating the control of the invention.

As best seen in the fluid control schematic of FIG. 9, the clamping fluid cylinders 51 and 54 on both positioning assemblies 22 are controlled by a common solenoid valve 60. Solenoid valve 60 is a two-position valve spring urged to a normal position seen in FIG. 9 so fluid under pressure is supplied to the closed ends of all of the cylinders 51 and 54 to extend the piston rods 52 and 55 thereof. As mentioned above, the stroke of all of the cylinders 51 and 54 is the same. Because of this and because each of the clamping cylinders 51 and 54 is mounted on the drive block 39 on support rod 35, the clamping faces 50 on the clamping jaws 49 are all located equidistant from the drive block 39 when the piston rods 52 and 55 are fully extended to open the clamp assemblies 42. FIG. 9 shows the clamping assemblies 42 in their fully open positions. The valve 60 is controlled by a solenoid 61 which transfers the valve 60, when energized, to supply fluid under pressure to the rod ends of the clamping cylinders 51 and 54 to retract piston rods 52 and 55. The valve 60 is connected to the rod ends of cylinders 51 and 54 through a four-way flow divider 62 which divides the fluid flowing therethrough equally between all of the clamping cylinders 51 and 54 so that all of the clamping jaws 49 move toward the drive blocks 39 at equal speeds. When the opposite sides of the cant are engaged by the clamping faces 50 on jaws 49 to clamp the cant therebetween and arrest the inward movement of the jaws 49 toward each other, the jaws 49 in each positioning assembly 22 will be located equidistant from the drive block 39 of that positioning assembly 22. This serves to transversely center the cant on the drive block 39 of each of the positioning assemblies 22 to facilitate the orientation thereof with respect to the infeed axis $A_I$ as will become more apparent.

As also seen in FIG. 9, the positioning cylinder $40_a$ in the far end positioning assembly $22_a$ is controlled by a three position solenoid valve 64 while the positioning cylinder $40_b$ in the near end positioning assembly $22_b$ is controlled by a three position solenoid valve 65. Valve 64 has a normal blocking position seen in FIG. 9 in which both the closed and rod ends of cylinder $40_a$ are blocked to maintain the piston rod thereof in a fixed position, a first transferred position to which the valve 64 is shifted when solenoid 66 thereon is energized to supply fluid under pressure to the rod end of cylinder $40_a$, and a second transferred position to which valve 64 is shifted when solenoid 68 thereon is energized to supply fluid under pressure to the closed end of cylinder $40_a$. When both of the solenoids 66 and 68 are deenergized, the valve 64 returns to its normal blocking position. Valve 65 also has a normal blocking position in which both the closed and rod ends of cylinder $40_b$ are blocked to maintain the piston rod thereof in a fixed position, a first transferred position to which the valve 65 is shifted when solenoid 69 thereon is energized to supply fluid under pressure to the rod end of cylinder $40_b$, and a second transferred position to which valve 65 is shifted when solenoid 70 thereon is energized to supply fluid under pressure to the closed end of cylinder $40_b$. Valve 65 also returns to its normal blocking position when both solenoids 69 and 70 are deenergized. The fluid under pressure is supplied to both valves 64 and 65 through a flow controller 71 which has the capability to vary the fluid flow therethrough to selectively control the speed at which cylinders $40_a$ and $40_b$ are operated as will become more apparent.

As will become more apparent, the valves 64 and 65 are automatically operated after the clamping cylinders 51 and 54 extend their piston rods to open the clamp assemblies 42 until the drive blocks 39 in positioning assemblies 22 are centered on the infeed axis $A_I$ as illustrated in FIG. 9. The drive blocks 39 are maintained in this centered position while the clamp assemblies 42 are closed to clamp the cant therebetween. Because the clamp assemblies 42 in each positioning assembly 22 are automatically centered on the drive block 39 of that clamp assembly 22 when they clamp the cant therebetween, it will be seen that the cant will be centered on the infeed axis $A_I$ at those positions where the clamp assemblies 42 engage the cant. This typically locates the cant so that the amount of movement thereof transversely of the axis $A_I$ to orient the cant with respect to the guide light beams is minimized.

After the clamp assemblies $42_a$ and $42_b$ clamp the cant therebetween, the operator can orient the cant with positioning cylinders $40_a$ and $40_b$. The operator can selectively energize the solenoid 66 or 68 on the solenoid valve 64 to respectively move the far end of the cant to the right or left of axis $A_I$ until that end of the cant is properly located with respect to the guide light beams 14. Likewise, the operator can selectively energize the solenoid 69 or 70 in the solenoid valve 65 to respectively move the near end of the cant to the right or left of axis $A_I$ until that end of the cant is properly located with respect to the guide light beams 14.

The manual operation of the positioning assemblies 22 is controlled by a single stick controller 100 seen in FIG. 1 on the control console 11. The controller 100 has a manually engageable handle 101 which is grasped by the operator who positions the handle at different positions to control the positioning assemblies. Such controllers 100 are commercially available under the tradename "Dynamaster" from Kockums Industries. Controller 100 has a trigger switch $SW_T$ schematically illustrated in FIG. 10 on the handle which is closed by the operator pressing thereon and effectively has four output switches $SW_1$-$SW_4$ also schematically illustrated in FIG. 10 controlled by the position of the handle as will become more apparent.

Figure 10:
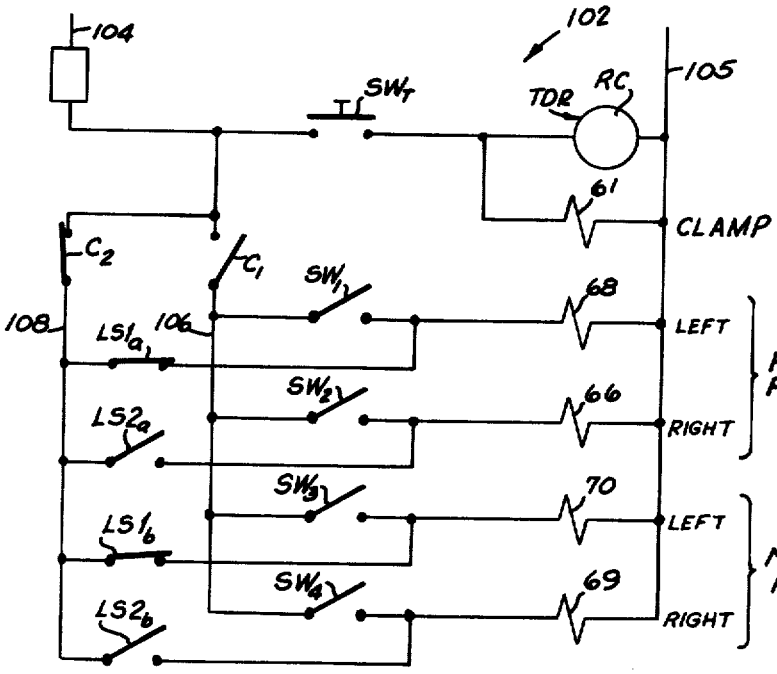
FIG. 10 is an electrical schematic for the invention.

As seen in FIG. 10, the control circuit 102 includes a common hot wire 104 and a common ground wire 105. The normally open switch $SW_T$ connects the solenoid 61 on clamp value 60 between wires 104 and 105 so that closure of switch $SW_T$ by the operator energizes solenoid 61 to cause the piston rods 52 and 55 of the clamping cylinders 51 and 54 to retract and the clamp assemblies 42 to clamp the cant therebetween. Switch $SW_T$ also connects the relay coil RC of time delay relay TDR to the wires 104 and 105 so that closure of switch $SW_T$ also energizes coil RC to cause relay TDR to start timing out as will become more apparent.

The normally open contacts $C_1$ on the time delay relay TDR connect the common hot wire 104 to the manual control hot wire 106 while the normally closed contacts $C_2$ on the time delay relay TDR connect the common hot wire 104 to the automatic control hot wire 108. Thus, it will be seen that the automatic control hot wire 108 has power thereon until the time delay relay TDR times out whereupon power is transferred to the manual control hot wire 106. The time required for relay TDR to time out is typically adjustable over about 0.1-10 seconds.

The output switch $SW_1$ on controller 100 connects the left solenoid 68 on the far end positioning valve 64 between the wires 106 and 105, the output switch $SW_2$ on controller 100 connects the right solenoid 66 on valve 64 between wires 106 and 105, output switch $SW_3$ on controller 100 connects left solenoid 70 on the near end positioning valve 65 between wires 106 and 105, and the output switch $SW_4$ on controller 100 connects the right solenoid 69 on the near end positioning valve 65 between wires 106 and 105.

As best seen in FIGS. 5 and 6, each positioning assembly 22 is provided with a pair of limit switches LS1 and LS2 used to locate the drive block 39 in registration with the infeed axis $A_I$ as will become more apparent. The limit switches LS1 and LS2 are mounted on a bracket 75 mounted on one of the supports 38 so that the switches LS1 and LS2 will be engaged by the end of the support rod 35 to actuate same. Switch LS1 is normally closed and switch LS2 is normally open. The switches LS1 and LS2 are adjustably mounted on bracket 75 so that the distance between the infeed axis $A_I$ and the switches can be adjusted. The switch LS1 is adjusted until the end of the support rod 35 just activates switch LS1 to open it when the drive block 39 is centered under axis $A_I$ and switch LS2 is adjusted until the end of the support rod 35 is just before activating switch LS2 when the drive block 39 is centered under axis $A_I$. Referring to FIG. 5, it will be seen that when the drive block 39 is moved in the left labelled direction away from the infeed axis $A_I$, the end of the support rod 35 will keep the limit switch LS1 in its transferred open position and will transfer the limit switch LS2 to its closed position. When the drive block 39 is moved in the right labelled direction away from infeed axis $A_I$, the end of the support rod will move away from the limit switches thereby allowing limit switch LS1 to transfer to its normal closed position and allowing switch LS2 to remain in its normal open position.

Returning now to FIG. 10, the limit switches for the far end positioning assembly $22_a$ have been labelled $LS1_a$ and $LS2_a$ while those for the near positioning assembly $22_b$ have been labelled $LS1_b$ and $LS2_b$ to distinguish them.

Limit switch $LS1_a$ connects the left solenoid 68 on the far end positioning valve 64 between the wires 108 and 105. Limit switch $LS2_a$ connects the right solenoid 66 on the far end positioning valve 64 between the wires 108 and 105. Limit switch $LS1_b$ connects the left solenoid 70 on the near end positioning valve 65 between wires 108 and 105. Limit switch $LS2_b$ connects the right solenoid 69 on the near end positioning valve 65 between wires 108 and 105.

When the operator releases switch $SW_T$, the time delay relay TDR is deenergized so that contacts $C_1$ close and contacts $C_2$ open. This removes power from the manual hot wire 106 and supplies power to the automatic hot wire 108. At this time, the limit switches LS1 and LS2 serve to automatically center the drive blocks 39 of each of the positioning assemblies 22 with the infeed axis $A_I$ as will be explained.

If the drive block $39_a$ on the far end positioning assembly $22_a$ is shifted to the right of the infeed axis $A_I$, then limit switches $LS1_a$ and $LS2_a$ will be in their normal positions so that limit switch $LS1_a$ is closed and limit switch $LS2_a$ is open. Thus, limit switch $LS1_a$ will energize the left solenoid 68 on the far end positioning valve 64 to cause the positioning cylinder $40_a$ to move the drive block $39_a$ to the left until the end of the support rod 35 transfers switch $LS1_a$ to open it when the guide block $39_a$ reaches the position where it is centered with the infeed axis $A_I$. On the other hand, if the drive block $39_a$ on the far end positioning assembly $22_a$ is shifted to the left of infeed axis $A_I$, then limit switches $LS1_a$ and $LS2_a$ will both be in their transferred positions so that switch $LS1_a$ is open and $LS2_a$ is closed. This causes the switch $LS2_a$ to energize the right solenoid 66 of the far end positioning valve 64 to cause the cylinder $40_a$ to move the drive block $39_a$ to the right until the end of support rod 35 releases switch $LS2_a$ to open it when the drive block $39_a$ is centered on the infeed axis $A_I$. Likewise, if the drive block $39_b$ on the near end positioning assembly $22_b$ is shifted to the right of infeed axis $A_I$, then limit switches $LS1_b$ and $LS2_b$ will be in their normal positions with switch $LS1_b$ closed and $LS2_b$ open. Limit switch $LS1_b$ then energizes the left solenoid 70 of the near end positioning valve 65 to cause the positioning cylinder $40_b$ to move the drive block $39_b$ to the left until the end of the support rod $35_b$ transfers limit switch $LS1_a$ to open it when the drive block $39_b$ is centered on the infeed axis $A_I$. If the drive block $39_b$ on the near end positioning assembly $22_b$ is shifted to the left of infeed axis $A_I$, then limit switches $LS1_b$ and $LS2_b$ will be in their transferred position so that switch $LS2_b$ will be closed and $LS1_b$ will be open. Thus, limit switch $LS2_b$ will energize the right solenoid 69 to cause the fluid cylinder $40_b$ to move the guide block $39_b$ to the right until the end of the support rod 35 clears switch $LS2_b$ to open it when the guide block $39_b$ is centered on the infeed axis $A_I$. Thus, it will be seen that regardless of the position of the guide blocks $39_a$ and $39_b$ with respect to the infeed axis $A_I$ when the operator releases the trigger switch $SW_T$, the guide blocks $39_a$ and $39_b$ will automatically be returned to their centered positions with respect to the infeed axis $A_I$.

Figure 11:
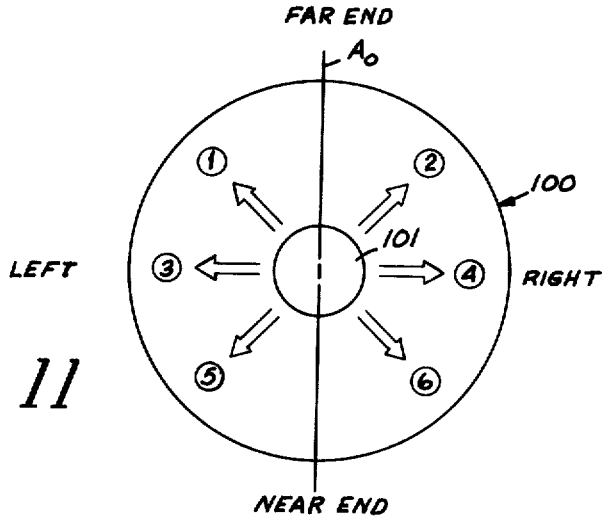
FIG. 11 is a functional schematic view illustrating the operation of the controller used in the invention.

To better understand the operation of the output switches $SW_1$–$SW_4$ of the controller 100, a schematic representation of the controller 100 is illustrated in FIG. 11. It will be seen that the controller 100 is oriented so that its operating central axis $A_O$ is oriented on the control console 11 to be generally parallel to the infeed axis $A_I$ on the infeed table assembly 10. The controller 100 is further oriented so that one end of the axis $A_O$ corresponds to the far end of the infeed table assembly 10 while the other end corresponds to the near end. These have been appropriately labelled for identification. It will be seen that the control handle 101 can be moved toward any one of six positions which have been labelled "1"–"6". The switches $SW_1$–$SW_4$ are connected to the controller 100 so that, when the handle 101 is moved toward position "1", the switch $SW_1$ will be closed; and when the handle 101 is moved toward position "2", the switch $SW_2$ will be closed. When the handle 101 is moved toward position "5", the switch $SW_3$ will be closed; and when the handle is moved toward position "6", the switch $SW_4$ will be closed. When the handle 101 is moved toward position "3", switches $SW_1$ and $SW_3$ will both be closed. When the handle 101 is moved toward position "4", switches $SW_2$ and $SW_4$ will both be closed. Thus, movement of the handle 101 toward positions "1" and "2" individually controls the far end positioning assembly $22_a$ and movement of the handle 101 toward positions "5" and "6" individually positions the near end positioning assembly $22_b$. Movement of the handle 101 toward positions "3" and "4" simultaneously positions both positioning assemblies 22.

From the foregoing, it will be seen that, after a cant has been deposited on top of the infeed rolls 30 from the feeding device FD, the operator presses the trigger switch $SW_T$ to close it. This energizes solenoid 61 on the clamping valve 60 to retract all of the clamping cylinders 51 and 54 and clamp the cant between the clamp assemblies 42. As already explained hereinabove, the cant is centered on the infeed axis $A_I$ at the positions where it is engaged by the clamping assemblies 42 of each positioning assembly 22. The operator typically then selects the spacing that the side heads SH in the edger E is to have to edge the cant using the appropriate control switches on the control console 11. This serves to shift the guide light beams 14 on the cant to provide guides for the operator to align the cant.

The time delay relay TDR is set to time out after the clamping cylinders 51 and 54 have had time to retract and clamp the cant between the clamp assemblies 42. When this occurs, the contacts $C_1$ close and the contacts $C_2$ open to disable the automatic control portion of the circuit and enable the manual control portion of the circuit by enabling switches $SW_1$–$SW_4$. The operator can then use the handle 101 on the controller 100 to appropriately shift the cant with respect to the guide light beams 14 until the guide light beams 14 lie on the face SF of the cant between the wanes W. When the operator has so positioned the cant using the handle 101 on the controller 100, he releases the trigger switch $SW_T$ to extend the clamping cylinders 51 and 54 and release the cant onto the top of the infeed rolls 30. Using an appropriate control on the control console 11, the operator can then power the infeed rolls 30 to drive the cant into the feeding section FS of the edger E along the infeed axis $A_I$ and edging path $P_E$. The feeding section FS engages the cant and continues to move the cant through the edger E along path $P_E$.

Releasing trigger switch $SW_T$ causes contacts $C_1$ and $C_2$ in the time delay relay TDR to transfer to their normal position so as to disable the switches $SW_1$–$SW_4$ and enable the limit switches LS1 and LS2 in the automatic control section of the control circuit so that the drive blocks 39 in both of the positioning assemblies 22 are returned to their centered position with respect to the axis $A_I$. Because the alignment process always starts from this centered position, the amount of movement of the cant with respect to the infeed axis $A_I$ by the positioning assemblies 22 is generally minimized, thereby minimizing the time required for the operator to align the cant with the guide light beams 14. This maximizes the speed of operation of the system.

It will also be noted that the clamp assemblies 42 move toward each other along straight horizontal paths rather than pivoting with respect to each other as they close. This serves to keep the cant flat on top of the infeed rolls 30 as the clamp assemblies 42 close rather than tending to pivot it away from this position as was experienced by prior art clamps with jaws that pivoted with respect to each other.

The cant turning assemblies 24 are also controlled from the control console 11. If a cant is deposited on top of the infeed rolls 30 from the feeding device FD with the wider sawn face SF of the cant turned upwardly, the operator activates the cant turning assemblies 24 to turn the cant over so that the narrower sawn face SF is facing upwardly to permit the guide light beams 14 to be aligned inside the wanes W on the narrower sawn face SF so that none of the wanes W will be left on the dimensioned lumber when the cant is edged.

Sometimes cants C are received on the infeed table assembly 10 which already have one of the sides of the cant trimmed to remove the wane and form a straight side edge SSE thereon as illustrated in FIG. 12. For orientation, the near and far ends have been labelled as well as the right and left sides as seen by the operator. The straight side edge SSE is illustrated on the right side of the cant but it is to be understood that it may be just as likely located on the left side of the cant. The guide light beams 14 and infeed axis $A_I$ have been superimposed on the cant in FIG. 12 to facilitate discussion.

On cants with a straight side edge SSE, it is usually desirable to align the straight edge with the guide light beam 14 on that side of the cant as is shown in FIG. 12. In other words, a cant with straight edge SSE on the right side thereof should be aligned with the right guide light beam 14 and a cant with straight edge SSE on the left side thereof should be aligned with the left guide light beam 14.

FIG. 13 illustrates a second embodiment of the control circuit which has been designated 110 that has the capability of aligning the straight edge SSE with the right or left hand guide light beams 14 on the infeed table assembly 10. The control circuit 110 has a position sensing section 111 and a control section 112. The position sensing section 111 serves to determine the position of the straight edge SSE of the cant C while the control section 112 serves to operate the positioning assemblies 22 to locate the straight edge SSE of the cant C on the desired guide light beam 14.

The control section 110 includes a common hot wire 114 and a common ground wire 115. The normally open trigger switch $SW_T$ connects the solenoid 61 of the clamp valve 60 between wires 104 and 105 just as in circuit 102 so that closure of switch $SW_T$ by the operator energizes solenoid 61 to cause the piston rods 52 and 55 of the clamping cylinders 51 and 54 to retract and the clamp assemblies 42 to clamp the cant therebetween. As in circuit 102, switch $SW_T$ also connects the relay coil RC of the time delay relay TDR to the wires 104 and 105 so that closure of the switch $SW_T$ also energizes coil RC to cause time delay TDR to start timing out as in circuit 102.

The normally open contacts $C_1$ on the time delay relay TDR connect the common hot wire 114 to the manual control hot wire 116 while the normally closed contacts $C_2$ of the time delay relay TDR connect the common hot wire 114 to the automatic control hot wire 118.

Right set push button switch $PB_R$ connects the coil RCRC of the right control relay RCR between wires 115 and 116. Likewise, the left set push button switch $PB_L$ connects the coil LCRC of the left control relay LCR between wires 115 and 116. As will become more apparent, the operator can selectively close the push button switch $PB_R$ or push button switch $PB_L$ depending on whether the straight side edge SSE of the cant C is to be aligned with the right guide light beam 14 or the left guide light beam 14.

Like circuit 102, the output switch $SW_1$ of controller 100 connects the left solenoid 68 on the far end positioning valve 64 between the wires 115 and 116; the output switch $SW_2$ on controller 100 connects the right solenoid 66 on valve 64 between wires 115 and 116; output switch $SW_3$ on controller 100 connects the left solenoid 70 on the near end positioning valve 65 between wires 115 and 116; and output switch $SW_4$ on controller 100 connects the right solenoid 69 on the near end positioning valve 65 between wires 115 and 116. Also, like circuit 102, limit switch $LS1_a$ connects the left solenoid 68 on the far end positioning valve 64 between wires 118 and 115 while limit switch $LS2_a$ connects the right solenoid 66 on the far end positioning valve 64 between wires 118 and 115. Limit switch $LS1_b$ connects left solenoid 70 on the near end positioning valve 65 between wires 118 and 115 while limit switch $LS2_b$ connects the right solenoid 69 on the near end positioning valve 65 between wires 118 and 115. It will be seen that the operation of the limit switches LS1 and LS2 and the control switches $SW_1$–$SW_4$ operate in the same manner as that described for the control circuit 102.

Unlike circuit 102, however, it will be seen that normally open contacts $CR_{1A}$-1 of relay $CR_{1A}$ also connect the left solenoid 68 on the far end positioning valve 64 between the wires 116 and 115 in parallel with switch $SW_1$. The normally open contacts $CR_{2A}$-1 of the control relay $CR_{2A}$ also connect the right solenoid 66 on valve 64 between valves 116 and 115 in parallel with switch $SW_2$. The normally open contacts $CR_{1B}$-1 of control relay $CR_{1B}$ connect the left solenoid 70 on the near end positioning valve 65 between wires 116 and 115 in parallel with switch $SW_3$. Also, the normally open contacts $CR_{2B}$-1 on control relay $CR_{2B}$ connect the right solenoid 69 on the near end positioning valve 65 between wires 116 and 115 in parallel with switch $SW_4$. These switches are controlled by the position sensing section 111 of the circuit as will become more apparent.

The position sensing section 111 of the circuit 110 includes a separate linear voltage dividing transducer LT connected to each of the clamp assemblies 42 so that the transducers LT provide a voltage output which is indicative of the position of the clamp assembly 42 with respect to the infeed axis $A_I$. Each of the linear transducer LT has an actuator AT which varies the voltage output of the linear transducer LT in response to the position of the actuator AT in the linear transducer LT. Such linear transducers are commercially available.

The linear transducers LT are all fixedly mounted on the infeed table assembly 10 and each has its actuator AT attached to one of the clamp assemblies 42 so that movement of clamp assembly 42 moves actuator AT with respect to transducer LT to vary its voltage output. The transducers LT illustrated are constructed so that the voltage output therefrom increases as its associated clamp assembly 42 moves away from infeed axis $A_I$. The transducers LT are located so that the value of the voltage output therefrom is the same for each transducer LT when the working face 50 on its associated clamp assembly 42 is located at the same distance from the infeed axis $A_I$. By doing this, not only can the distance between the working face 50 on each clamp assembly 42 be accurately determined, but also the distance between the infeed axis and the working faces 50 of the different clamping assemblies 42 can be matched.

To distinguish between the different linear transducers LT, the linear transducer associated with the left hand clamp assembly $42_a$ in the far end positioning assembly $22_a$ has been designated $LT_{AL}$ while that linear transducer associated with the right hand clamp assembly $42_a$ of the far end positioning assembly $22_a$ has been designated $LT_{AR}$. The linear transducer associated with the left hand clamp assembly $42_b$ of the near end positioning assembly $22_b$ has been designated $LT_{BL}$ and that linear transducer associated with the right hand clamp assembly $42_b$ in the near end positioning assembly $22_b$ has been designated $LT_{BR}$. The input of each of the linear transducers is connected to a regulated power supply RPS to provide the same voltage input to all of the linear transducers so that their outputs will be indicative of the relative position of the clamp assembly 42 with respect to the infeed axis $A_I$. To distinguish between the output of the linear transducers, the output of the linear transducer $LT_{AL}$ has been designated $O_{AL}$; the output of the linear transducer $LT_{AR}$ has been designated $O_{AR}$; the output of the linear transducer $LT_{BL}$ has been designated $O_{BL}$; and the output of the linear transducer $LT_{BR}$ has been designated $O_{BR}$.

As explained hereinabove, guide light beams 14 can be set for different widths of lumber to which the edger E will edge the cant C. These settings are typically 4, 6, 8, 10 and 12 inches. Because the working faces 50 of the clamping assemblies 42 on the straight edge side of the cant C engage the straight side edge SSE, it will be seen that, when the straight side edge SSE is aligned with the guide light beam 14 on the same side of the cant, the working faces 50 will likewise be spaced the same distance from the infeed axis $A_I$ as the guide light beam 14. Thus, if the right hand side of the cant C has the straight edge SSE thereon, the straight edge SSE will be aligned with the right guide light beam 14 when the working faces 50 on the clamp assemblies $42_a$ and $42_b$ on the right side of the infeed table assembly 10 are spaced the same distance from the infeed axis $A_I$ as the right guide light beam 14 is spaced from the infeed axis $A_I$. Likewise, if the left hand side of cant C has the straight side edge SSE thereon, the straight side edge SSE will be aligned with the left guide light beam 14 when the working faces 50 on the clamp assemblies $42_a$ and $42_b$ on the left side of the infeed table assembly 10 are spaced the same distance from the infeed axis $A_I$ as the left guide light beam is spaced from the infeed axis $A_I$. Thus, the side edge SSE of cant C can be located in alignment with guide light beam 14 by locating the appropriate clamping faces 50 on the clamp assemblies $42_a$ and $42_b$ the same distance from the infeed axis $A_I$ as that of the guide light beam 14. The position sensing section 111 is used with control section 112 to match the distance between the working faces 50 on clamp assemblies 42 and axis $A_I$ with the distance between the guide light beams 14 and axis $A_I$.

The output voltage of each of the linear transducers LT when the distance between the axis $A_I$ and the working face 50 on the clamping assembly 42 associated therewith equals the distance between the axis $A_I$ and the guide light beam 14 at each of its settings is known. This allows the output of the linear transducer to be matched with a known reference voltage than the linear transducer will have when the spacing between the working face on the clamp assembly 42 matches the spacing of the guide light beam 14 from the infeed axis $A_I$. The spacing of the guide light beams 14 is selected by the operator using a series of edger set switches $SW_E$ on the control console 11. The switches $SW_E$ are schematically illustrated in FIG. 13. The switches $SW_E$ are connected to a reference voltage network RVN which causes the reference voltage network RVN to generate a reference voltage output $O_R$ which is equal to the voltage output each linear transducers LT will have when the working face 50 on the clamp assembly 42 associated therewith is located the same distance from the infeed axis $A_I$ as the guide light beams 14. In other words, the reference voltage output $O_R$ will be different for each setting of the edger and guide light beams 14 and will correspond in value to that which the output of the linear transducer will have when the working face 50 on the clamp assembly 42 associated therewith is located at that same distance from infeed axis $A_I$. Thus, by comparing the voltage output from the linear transducer LT with the reference voltage $O_R$, the distance between the working face 50 on each clamp assembly 42 and axis $A_I$ will be matched with the distance between the guide light beam 14 and axis $A_I$ when the voltage output of the linear transducer LT equals the reference voltage output $O_R$.

The voltage comparison for each linear transducer LT is made by a pair of comparators CP-L and CP-R. Comparators CP-L and CP-R have the same construction and generate an output only when the voltage value at the "+" exceeds the voltage value at the "−" input. The output of each of the linear transducers LT is connected to the "−" input of comparator CP-L and to the "+" of comparator CP-R. Likewise, the reference voltage output $O_R$ of the reference voltage network RVN is connected to the "+" input of the comparator CP-L and to the "−" input of the comparator CP-R of the comparators associated with each of the linear transducers. To distinguish between the different linear transducers, the same subscripts applied to the linear transducers LT are applied to its associated comparators. Thus, the output $O_{AL}$ of linear transducer $LT_{AL}$ is applied to comparators $CP_{AL}$-L and $CP_{AL}$-R; the output $O_{AR}$ of linear transducer $LT_{AR}$ is applied to the comparator $CP_{AR}$-L and $CP_{AR}$-R; the output $O_{BL}$ of linear transducer $LT_{BL}$ is applied to the comparators $CP_{BL}$-L and $CP_{BL}$-R while the output $O_{BR}$ of linear transducer $LT_{BR}$ is applied to the comparators $CP_{BR}$-L and $CP_{BR}$-R.

The output of the comparator $CP_{AL}$-L is connected to the relay coil of relay $CR_{1A}$ through normally open contacts $LCR_1$ of the left set relay LCR while the output of the comparator $CP_{AL}$-R is connected to the coil of relay $CR_{2A}$ through normally open contacts $LCR_2$ of left set relay LCR. The output of comparator $CP_{AR}$-L is connected to the coil of relay $CR_{1A}$ through normally open contacts $RCR_1$ of the right set relay RCR while the output of comparator $CP_{AR}$-R is connected to the coil of relay $CR_{2A}$ through the normally open contacts $RCR_2$ of the right set relay RCR. The output of the comparator $CP_{BL}$-L is connected to the coil of relay $CR_{1B}$ through normally open contacts $LCR_3$ of the left set control relay LCR while the output of the comparator $CP_{BL}$-R is connected to the coil of relay $CR_{2B}$ by normally open contacts $LCR_4$ of the left set control relay RCR. The output of comparator $CP_{BR}$-L is connected to the coil of relay $CR_{1B}$ through the normally open contacts $RCR_3$ of the right set control relay RCR and the output of comparator $CP_{BR}$-R is connected to the coil of relay $CR_{2B}$ by normally open contacts $RCR_4$ of right set control relay RCR. In effect, it will be seen that closure of the right set push button switch $PB_R$ energizes coil RCRC of the right set relay RCR to close contacts $RCR_1$-$RCR_4$ to render the outputs from the comparators associated with the linear transducers $LT_{AR}$ and $LT_{BR}$ connected to the right hand clamp assemblies $42_a$ and $42_b$ in positioning assemblies $22_a$ and $22_b$ operative. Likewise, closure of push button switch $PB_L$ will energize the left set control relay LCR to close contacts $LCR_1$-$LCR_4$ to render the outputs of the comparators associated with the linear transducers $LT_{AL}$ and $LT_{BL}$ connected to the left hand clamp assemblies $42_a$ and $42_b$ in positioning assemblies $22_a$ and $22_b$ operative.

The right and left set operations of the circuit 110 will be understood by considering an example. For instance, assuming that the straight side edge SSE of the cant C is located on the right hand side of the cant and that the appropriate edger set switch $SW_E$ has been selected and depressed, the reference voltage output $O_R$ of the reference voltage network RVN will be equal to that which the right hand linear transducers $LT_{AR}$ and $Lt_{BR}$ will have when the working faces 50 on the right hand clamp assemblies $42_a$ and $42_b$ in the positioning assemblies $22_a$ and $22_b$ are located at the same spacing from the infeed axis $A_I$ as that of the right hand guide light beam 14. After the operator has depressed the trigger switch $SW_T$ to clamp the cant between the clamp assemblies 42 and the time delay relay TDR is timed out so that the contacts $C_1$ thereof close to power the manual control hot wire 116, the operator simply closes the right set push button switch $PB_R$ to energize coil RCRC of the right set control relay RCR and close its contacts $RCR_1$-$RCR_4$. This renders the outputs of linear transducers $LT_{AR}$ and $LT_{BR}$ associated with the right hand clamp assemblies $42_a$ and $42_b$ in positioning assemblies $22_a$ and $22_b$ operative.

If the clamping face 50 on the right hand clamp assembly $42_a$ of the far end positioning assembly $22_a$ is located closer to the infeed axis $A_I$ than the right hand guide light beam 14, then the voltage output $A_R$ of the linear transducer $LT_{AR}$ will be less than the reference voltage output $O_R$ from the reference voltage network RVN. This will cause output to be generated by the comparator $CP_{AR}$-R. This will in turn energize the coil of the control relay $CR_{2A}$ to close contacts $CR_{2A}$-1 and energize the right solenoid 66 in the far end positioning valve 64. Fluid will be supplied to cylinder $40_a$ to cause the drive block $39_a$ in the far end positioning assembly $22_a$ to move to the right thereby moving the working face 50 of the right hand clamp assembly $42_a$ in the far end positioning assembly $22_a$ to the right. As the right hand clamp assembly $42_a$ is moved to the right, the value of output $O_{AR}$ from linear transducer $LT_{AR}$ increases. When the working face 50 on the right hand clamp assembly $42_a$ in the far end positioning assembly $22_a$ reaches the position of where it is spaced from the infeed axis $A_I$ the same distance that the right guide light beam 14 is located from the infeed axis $A_I$, the voltage output $O_{AR}$ will equal the value of the reference voltage output $O_R$ and the output from the comparator $CP_{AR}$-R will cease. This deenergizes the coil of relay $CR_{2A}$ to open contact $CR_{2A}$-1 and thus deenergize the solenoid 66. Because the voltage output $O_{AR}$ from the linear transducer $LT_{AR}$ is always less than or equal to the reference voltage output $O_R$ during the operation, there will be no output from the comparator $CP_{AR}$-L. Thus, the movement of the positioning cylinder $40_a$ will be arrested with the working face 50 on the right hand clamp assembly $42_a$ at the same spacing from infeed axis $A_I$ as that of the right guide light beam 14.

On the other hand, if the working face 50 on the right hand clamp assembly $42_a$ of the far end position of assembly $22_a$ is located from the infeed axis $A_I$ further than that of the right guide light beam 14 when the push button switch $PB_R$ is closed, then comparator $CP_{AR}$-L will generate an output because the voltage output $O_{AR}$ of the linear transducer $LT_{AR}$ is greater than that of the reference voltage output $O_R$ from the reference voltage network RVN. This causes the coil of relay $CR_{1A}$ to be energized to close contacts $CR_{1A}$-1 and energize the left solenoid 68 of the far end positioning valve 64. Valve 64 causes the far end positioning cylinder $40_a$ to move the drive block $39_a$ to the left moving the right hand clamp assembly $42_a$ in the far end positioning assembly $22_a$ therewith. Movement of the right hand clamp assembly $42_a$ causes the output $O_{AR}$ of the linear transducer $LT_{AR}$ to decrease in value. When the value of output $O_{AR}$ matches the value of the reference voltage output $O_R$, the output from the comparator $CP_{AR}$-L ceases and relay $CR_{1A}$ is deenergized to stop the motion of the far end positioning cylinder $40_a$ so that the working face 50 on the right hand clamp assembly $42_a$ in the far end positioning assembly $22_a$ is spaced the same distance from the infeed axis $A_I$ as the right guide light beam 14. Thus, it will be seen that, regardless of whether the working face 50 on the right hand clamp assembly $42_a$ in the far end positioning assembly $22_a$ is further away from or closer to the infeed axis $A_I$ than the right guide light beam 14, the working face 50 on the right hand clamp assembly $42_a$ will be moved appropriately to a position so that it is spaced the same distance from the infeed axis $A_I$ as that of the right hand guide light beam 14.

At the same time that the right hand clamp assembly $42_a$ in the far end positioning assembly $22_a$ is being positioned, the right hand clamp assembly $42_b$ in the near end positioning assembly $22_b$ is also being positioned. If the working face 50 on the right hand clamp assembly $42_b$ in the near end position of the assembly $22_b$ is nearer to the infeed axis $A_I$ than that of the right guide light beam 14, the output $O_{BR}$ of the linear transducer $LT_{BR}$ will have a value less than the value of the reference voltage output $O_R$ from the reference voltage network RVN. This will cause the comparator $CP_{BR}$-R to generate an output to energize the coil in relay $CR_{2B}$. Contacts $CR_{2B}$-1 close to energize the right solenoid 69 in the near end positioning valve 65. This in turn causes the positioning cylinder $40_b$ in the near end positioning assembly $22_a$ to move the drive block $39_b$ to the right, thereby moving the right clamping assembly $42_b$ to the right. Movements of the right hand clamp assembly $42_b$ causes the output $O_{BR}$ from the linear transducer $LT_{BR}$ to increase. When the value of the output $O_{BR}$ equals the value of the reference voltage output $O_R$ from the reference voltage network RVN, the working face 50 on the right hand clamp assembly $42_b$ in the near end positioning assembly $22_b$ is at the same spacing from the infeed axis $A_I$ as that of the right guide light beam 14 from the infeed axis $A_I$. When the output from the linear transducer $LT_{BR}$ equals the output $O_R$ from the reference voltage network RVN, the output from the comparator $CP_{BR}$-R ceases and the coil of relay $CR_{2B}$ is deenergized, thereby opening contacts $CR_{2B}$-1 to deenergize the solenoid 69 and stop the near end positioning at cylinder $40_b$ in that position. On the other hand, if the working face 50 on the right hand clamp assembly $42_b$ in the near end positioning assembly $22_b$ is further away from the infeed axis $A_I$ than that of the right guide light beam 14, then the output $O_{BR}$ of the linear transducer $LT_{BR}$ will be greater than the reference voltage output $O_R$ of the reference voltage network RVN. This causes the comparator $CP_{BR}-L$ to generate an output which energizes the coil of relay $CR_{1B}$ and closes contacts $CR_{1B}-1$ to energize the left solenoid 70 in the near end positioning valve 65. This causes the near end positioning cylinder $40_b$ to move the drive block $39_b$ to the left. When the working face 50 on the right hand clamp assembly $42_b$ in the near end positioning assembly $22_b$ reaches the same spacing as the right guide light beam 14 from the infeed axis $A_I$, the value of the output $O_{BR}$ from the linear transducer $LT_{BR}$ equals that of the reference voltage output $O_R$ so that the output from the comparator $CP_{BR}-L$ ceases and the coil or relay $CR_{1B}$ is deenergized to open contacts $CR_{1B}-1$. This deenergizes the left solenoid 70 in the near end positioning valve 65 to stop the near end positioning cylinder $40_b$ with the working face 50 on the right hand clamp assembly $42_b$ in the near end positioning assembly $22_b$ spaced the same distance from the infeed axis $A_I$ as that of the right guide light beam 14. Thus, it will be seen that, while the far end positioning assembly $22_a$ is positioning the working face 50 on the right hand clamp assembly $42_a$ so that it is spaced the same distance from the infeed axis $A_I$ as the right hand guide light beam 14, the near end positioning assembly $22_b$ is simultaneously positioning the working face 50 on the right hand clamp assembly $42_b$ so that it is also located the same distance from infeed axis $A_I$ as the right hand guide light beam 14. Since the straight side edge SSE is engaged by the working faces 50 on the right hand clamp assemblies $42_a$ and $42_b$, the straight side edge SSE will be located in alignment with the right hand guide light beam 14. When this occurs, the operator simply releases the push button switch $PB_R$ and the trigger switch $SW_T$ to release the cant C on the infeed rolls 30 with the straight side edge SSE in registration with the right hand guide light beam 14. The operator then activates the infeed rolls 30 to move the cant C into the edger E along the infeed axis $A_I$ so that this orientation is maintained.

If the straight side edge SSE is located on the left hand side of the cant, then the operator would close the push button switch $PB_L$ rather than the push button switch $PB_R$ to energize the left set relay LCR thereby closing contacts $LCR_1-LCR_4$. This would cause the linear transducer $LT_{AL}$ to operate the comparator $CP_{AL}-L$ or $CP_{AL}-R$ and energize the relay $CR_{1A}$ or $CR_{2A}$ to move the working face 50 on the left hand clamp assembly $42_a$ in the far end positioning assembly $22_a$ until it is spaced the same distance from the infeed axis $A_I$ as the left hand guide light beam 14. Simultaneously, the linear transducer $LT_{BL}$ would operate the comparator $CP_{BL}-L$ or $CP_{BL}-R$ and energize the relay $CR_{1B}$ or $CR_{2B}$ until the working face 50 on the left hand clamp assembly $42_b$ in the near end positioning assembly $22_b$ is spaced from the infeed axis $A_I$ the same distance as the left hand guide light beam 14. This, of course, would align a straight edge SSE on the left hand side of the cant C with the left hand guide light beam 14 so that the cant C would be released and moved into the edger E by the infeed rolls 30 with this position maintained. Thus, rather than having to manipulate the handle 101 on the controller 100 to position the cant with respect to the infeed axis $A_I$, the circuit 110 allows the operator to quickly and simply align a cant with a straight side edge SSE with the right or left guide light beam 14 simply by selectively depressing push button switch $PB_R$ or $PB_L$. This allows greater flexibility and speed in properly orienting the cant C with respect to the infeed axis $A_I$ since the operator can use the controller 100 to orient the cant C when both side edges of the cant C have wanes W on them and can easily and quickly moves cants with a straight side edge SSE thereon to the desired guide light beam 14 using the right or left push button switch $PB_R$ or $PB_L$.

While the position sensing section 111 is disclosed using linear transducers, it is understood that the same results can be obtained using linear potentiometers or linear activated switch mechanisms without departing from the scope of the invention.

What is claimed as invention is:

1. An infeed table for an edging device adapted to trim the longitudinal wane edges of a sawn cant to produce dimensioned lumber from the cant as the cant is moved therethrough along a prescribed edging path, said infeed table including a support frame;

infeed conveyor means for feeding the sawn cant longitudinally into said edging device along the edging path;

first and second clamping means positioned along said infeed conveyor means at spaced apart positions, each of said first and second clamping means having a clamping position clamping the cant therein and a release position releasing the cant onto said infeed conveyor means for movement of the cant into the edging device along the edging path, each of said clamping means including positioning means for selectively shifting said clamping means transversely of the prescribed edging path to selectively position the cant on said infeed conveyor means with respect to the edging path;

manually operated clamp control means for selectively moving said first and second clamping means to the clamped position when manually activated and for selectively moving said first and second clamping means to the release position when manually released;

manually operated positioning control means for selectively causing said positioning means to shift said first and second clamping means transversely of the edging path to selectively position opposite ends of the cant with respect to the edging path;

automatic positioning control means for causing said positioning means to center said first and second clamping means with respect to the edging path; and interconnect means interconnecting said manually operated clamp control means, said manually operated positioning control means and said automatic positioning control means so that said manually operated positioning control means is enabled while said clamp control means is manually activated and disabled while said clamp control means is manually released and so that said automatic positioning control means is enabled while said clamp control means is manually released and disabled while said clamp control means is manually activated.

2. The infeed table of claim 1 wherein said manually operated positioning control means includes first manual input means for selectively causing said positioning means to shift said first and second clamping means transversely of the edging path to any selected position with respect to the edging path and second manual input means for causing said positioning means to shift said first and second clamping transversely of the edging path to locate both ends of the cant at a prescribed position with respect to the edging path.

3. The infeed table of claim 1 wherein said first and second clamping means each includes a pair of spaced apart clamping jaws adapted to engage the cant on opposite sides thereof to clamp the cant therebetween the jaw positioning means for moving said clamping jaws toward and away from each other along a straight common path.

4. The infeed table assembly of claim 1 wherein each of said first and second clamping means includes a support assembly slidably positioned on said support frame for movement along a positioning path transversely of the edging path, said positioning means selectively moving said support assembly along said positioning path; a pair of clamping jaw assemblies slidably mounted on said support assembly for linear movement toward and away from each other along said positioning assembly to selectively clamp the cant therebetween; and clamp drive means for selectively moving said clamping jaw assemblies toward and away from each other on said support assembly independently of said positioning means while maintaining said clamping assemblies equally spaced on opposite sides of a prescribed location on each slide assembly.

5. The infeed table of claim 1 wherein said manually operated clamp control means and said manually operated positioning control means includes a single stick controller including a manually engageable handle thereon, trigger switch means on said handle operatively connected to said first and second clamping means to move said first and second clamping means to the clamp position when said trigger switch means is manually activated and for selectively moving said first and second clamping means to the release position when said trigger switch means is manually released, and a plurality of output switch means operatively connected to said handle so that said plurality of output switch means are operated by the position of said handle, said pluraltiy of output switch means operatively connected to said positioning means for selectively causing said positioning means to shift said and first and second clamping means transversely of the edging path to selectively position opposite the ends of the cant with respect to the edging path as the position of said handle is manually controlled.

6. The infeed table of claim 1 wherein said first and second clamping means each includes an elongate support rod, support means mounted on said support frame slidably mounting said support rod therein so that said support rod is axially movable along a horizontal path normal to the edging path, drive block means fixedly mounted on said support rod at a position centrally of the length of said support rod, a pair of clamp assemblies slidably mounted on said support rods on opposite sides of said drive block means, each of said clamp assemblies defining a working face thereon facing said drive block means and adapted to engage the cant as said clamp assemblies are moved toward said drive block means, alignment means for preventing rotation of said clamp assemblies about said support rods as said clamp assemblies are slidably moved therealong, a first fluid cylinder mounted on said drive block means and connected to one of said clamp assemblies for selectively moving said clamp assembly along said support rod, and a second fluid cylinder mounted on said drive block means and operatively connected to the other of said clamp assemblies for selectively moving said clamp assembly along said support rod, said first and second fluid cylinders constructed and arranged to keep said working faces on said clamp assemblies equally spaced on opposite sides of said drive block means as said clamp assemblies are moved toward said drive block means, and wherein said positioning means includes a positioning fluid cylinder operatively connected to said drive block means and said support frame for selectively moving said drive block means together with said support rod, said clamp assemblies and said first and second fluid cylinders with respect to the prescribed edging path, said automatic positioning control means operatively connected to said positioning fluid cylinder to cause said positioning fluid cylinder to move said drive block means to a position centered with respect to the edging path.

7. The infeed table of claim 6 wherein said manually operated positioning control means includes side set means operatively connected to said positioning fluid cylinders in said first and second clamping means for selectively locating said clamping faces on said clamp assemblies on one side of the edging path at a prescribed first edge set distance from the edging path and for alternatively locating said clamping faces on said clamp assemblies on the opposite side of the edging path at a prescribed second edge set distance from the edging path.

8. The infeed table of claim 7 further including guide light means for projecting a pair of spaced apart guide light beams on opposite sides of the edging path parallel thereto so that the guide light beams are superimposed on the cant on said infeed conveyor means, said side set means selectively causing said positioning fluid cylinders to locate the working faces on said clamp assemblies one side of the edging path in alignment with the guide light beam on the same side of the edging path and for alternatively locating said working faces on said clamp asemblies on the opposite side of the edging path in alignment with the guide light beams on tht side of the edging path.

9. The infeed table of claim 1 further including guide light means for projecting a pair of spaced apart guide light beams onto a cant on said infeed conveyor means, the guide light beams located parallel to and on opposite sides of the edging path at positions corresponding to the locations at which the edging device will cut the cant as the cant passes through the edging device so that said manually operated positioning control means can be used to locate the cant with respect to the guide light beams for edging.

10. The infeed table of claim 9 wherein each of said clamping means includes a pair of spaced apart clamping jaws on opposite sides of the edging path defining opposed clamping faces thereon; and further including first side set control means operatively connected to said first and second clamping means for selectively locating the clamping faces on said clamping jaws on one side of the edging path in alignment with the guide light beam on the same side of the edging path and for alternatively selectively locating the clamping faces on said clamping jaws on the opposite side of the edging path in alignment with the guide light beam on that side of the edging path.

* * * * *